US009802205B2

(12) United States Patent
Newman

(10) Patent No.: US 9,802,205 B2
(45) Date of Patent: Oct. 31, 2017

(54) PARTICLE SEPARATION SYSTEM

(71) Applicant: FORD GLOBAL TECHNOLOGIES, LLC, Dearborn, MI (US)

(72) Inventor: Matthew Newman, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 603 days.

(21) Appl. No.: 14/279,952

(22) Filed: May 16, 2014

(65) Prior Publication Data

US 2015/0328644 A1 Nov. 19, 2015

(51) Int. Cl.

| | |
|---|---|
| ***B03C 1/24*** | (2006.01) |
| ***B03C 1/28*** | (2006.01) |
| ***B03C 1/12*** | (2006.01) |
| ***B03C 1/033*** | (2006.01) |
| ***B03C 1/247*** | (2006.01) |

(52) U.S. Cl.

CPC ..... *B03C 1/24* (2013.01); *B03C 1/0332* (2013.01); *B03C 1/12* (2013.01); *B03C 1/247* (2013.01); *B03C 1/286* (2013.01); *B03C 2201/18* (2013.01); *B03C 2201/20* (2013.01); *B03C 2201/30* (2013.01)

(58) Field of Classification Search

CPC ..... B03C 1/24; B03C 1/0332; B03C 1/286; B03C 1/12; B03C 1/247; B03C 2201/18; B03C 2201/30; B03C 2201/20

See application file for complete search history.

(56) References Cited

U.S. PATENT DOCUMENTS

| | | | | |
|---|---|---|---|---|
| 2,748,940 A * | 6/1956 | Roth | B03C 1/12 209/219 |
| 2,939,580 A * | 6/1960 | Carpenter | B03C 1/12 209/2 |
| 3,168,464 A * | 2/1965 | Ferris | B03C 1/14 209/223.1 |
| 3,830,367 A | 8/1974 | Stone | |

(Continued)

FOREIGN PATENT DOCUMENTS

| | | |
|---|---|---|
| CN | 2356750 Y | 1/2000 |
| CN | 102351654 A | 2/2012 |
| EP | 2644277 A2 | 10/2013 |

OTHER PUBLICATIONS

"Stronger Than Dirt"; http://www.pfonline.com/articles/stronger-than-dirt; Article from: Products Finishing, Pauline Paul from CUNO, Inc., pp. 1-4, accessed Apr. 3, 2014.

(Continued)

*Primary Examiner* — David C Mellon
(74) *Attorney, Agent, or Firm* — Jason Rogers; Brooks Kushman P.C.

(57) ABSTRACT

A particle separator including a rotor disposed inside a housing. The rotor has a plurality of magnetic sections that are arranged with alternating poles. A drive rotates the rotor to generate a changing magnetic field. Magnetic particles and non-magnetic conductive particles are removed from a liquid that flows through the particle separator. The magnetic particles attach to the rotor and the non-magnetic conductive particles are repelled away from the rotor by the changing magnetic field.

8 Claims, 3 Drawing Sheets

(56) References Cited

U.S. PATENT DOCUMENTS

| | | | | |
|---|---|---|---|---|
| 3,998,741 | A * | 12/1976 | Councell | B03C 1/12 209/222 |
| 5,060,871 | A | 10/1991 | Brassinga et al. | |
| 2003/0066791 | A1* | 4/2003 | Yaegashi | C23C 22/00 210/167.29 |
| 2004/0007249 | A1 | 1/2004 | Kishi et al. | |
| 2014/0231358 | A1* | 8/2014 | Gokpekin | B03C 1/14 210/695 |

OTHER PUBLICATIONS

Metal Coatings Corp, "Phosphate Coating & Phosphating", http://www.metcoat.com/phosphate-coatings.htm, pp. 1-2, accessed May 9, 2014.

Clearclad, "A Brief History History of E-Coat", http://www.clearclad.com/clearclad_resources/ecoat.htm. pp. 1-3; accessed May 9, 2014.

"Electrophoretic Deposition", From Wikipedia, the free encyclopedia; http://en.wikipedia.org/wiki/Electrophoretic_deposition; pp. 1-9, accessed May 9, 2014.

"Lenz's Law", From Wikipedia, the free encyclopedia; http://en.wikipedia.org/wiki/Lenz%27s_law; pp. 1-4; accessed May 9, 2014.

"Phosphate Conversion Coating," From Wikipedia, the free encyclopedia; http://en.wikipedia.org/wiki/Phosphate_conversion_coating; pp. 1-3; accessed May 9, 2014.

Chinese Patent Office, First Office Action for the corresponding Chinese Patent Application No. 201510250773.X, dated Aug. 3, 2017.

* cited by examiner

PARTICLE SEPARATION SYSTEM

TECHNICAL FIELD

The present disclosure relates to a particle separator that is configured to remove magnetic and non-magnetic conductive particles from a liquid.

BACKGROUND

Automobile body-in-white units accumulate metal particulates during the manufacturing and assembly processes such as weld balls, metal shavings, metal dust, and the like. The metal particulates may cause several different issues when they remain on an e-coated automobile body including, surface defects, star bursting, and galvanic corrosion.

The metal particulates may be removed from automobile bodies in the paint shop, during the phosphate coating and e-coating stages. The phosphate coating and e-coating systems are then filtered to remove the metal particulates.

Automobile bodies have traditionally been made from ferrous metals but may now include non-ferrous materials as well. It would be desirable to provide a particle separation system that removes ferrous metal particulates and non-ferrous material particulates from the phosphate coating and e-coating systems.

SUMMARY

In one aspect of the disclosure, a particle separator for a flowing liquid is provided. The particle separator includes a rotor that is disposed inside a housing. The rotor has a plurality of magnetic sections that are arranged with alternating poles. The plurality of magnetic sections generate a changing magnetic field when rotated by a drive. Magnetic particles and non-magnetic conductive particles are removed from the liquid as it flows through the particle separator. The magnetic particles attach to the rotor and the non-magnetic conductive particles are repelled away from the rotor by the changing magnetic field.

In another aspect of the disclosure, a particle separation system for removing magnetic and non-magnetic conductive particles from a liquid coating is provided. The system includes an immersion tank that contains a liquid coating. A particle separator, that has a plurality of magnetic sections with alternating poles, is disposed inside a housing. The particle separator generates a changing magnetic field when it is rotated by a drive. The liquid coating flows into the housing from the immersion tank through a first channel. Magnetic particles and non-magnetic conductive particles are removed from the liquid coating as it flows through the particle separator. The magnetic particles in the liquid coating attach to the plurality of magnetic sections in the particle separator. The changing magnetic field induces an eddy current in the non-magnetic conductive particles. The non-magnetic conductive particles in the liquid coating are then repelled by the changing magnetic field in a direction away from the flow of the liquid coating. The liquid coating is then returned to the immersion tank through a second channel.

In yet another aspect of the disclosure, a method for removing magnetic and non-magnetic conductive particles from a liquid is provided. The liquid is supplied to a particle separator. The particle separator has a plurality of magnets that are arranged with alternating poles. The magnets are configured to generate a changing magnetic field when rotated. The magnets are rotated about a pivot while the liquid is flowing through the particle separator. Magnetic particles are collected on the magnets. Eddy currents are induced into the non-magnetic conductive particles by the changing magnetic field. Non-magnetic conductive particles are then repelled away from the flow of the liquid by the changing magnetic field. The liquid is then flowed out of the particle separator.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
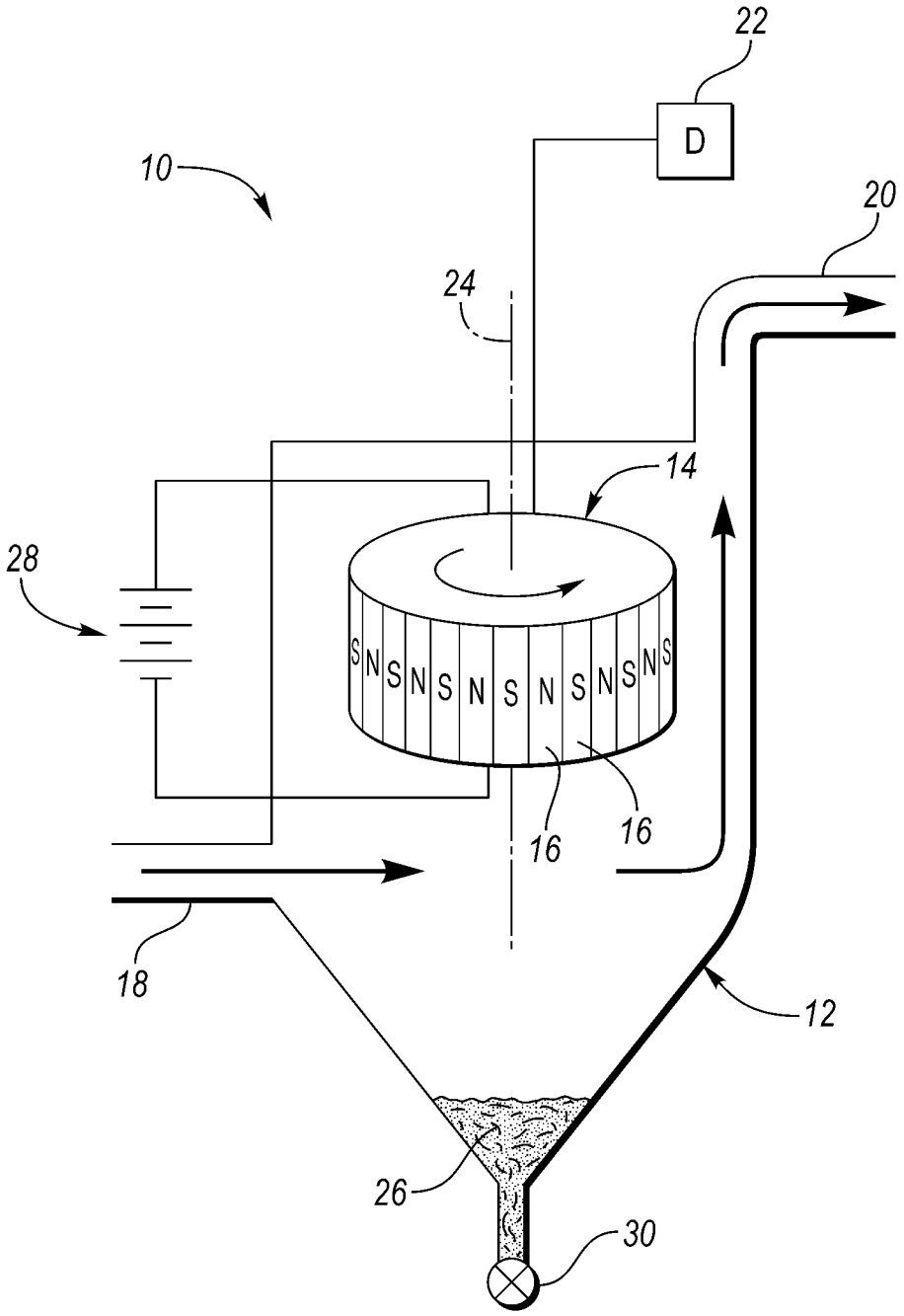
FIG. 1 is a diagrammatic view of particle separator made according to one example of this disclosure.

Referring to FIG. 1, a particle separator 10 is disclosed that is configured to remove magnetic particles and non-magnetic conductive particles from a flowing liquid. Magnetic particles include ferrous metals such as iron or steel, and any other metal, alloy, or material that is capable of being attracted by a magnet. Non-magnetic conductive particles include metals such as aluminum, aluminum alloys, magnesium, magnesium alloys, copper, copper alloys, zinc, zinc alloys, brass, and any other conductive metal, alloy, or material that is not capable or only negligibly capable of being attracted by a magnet.

The particle separator 10 consists of a housing 12 that contains a rotor 14. The rotor 14 has a plurality of magnetic sections 16 that have alternating poles. The particle separator 10, in the alternative, may be comprised of more than one rotor 14 that each has a plurality of magnetic sections 16 with alternating poles. The housing 12 has an inlet 18 and an outlet 20 where the liquid containing magnetic and non-magnetic particles may flow into and out of the housing 12, respectively. The inlet 18 is located upstream of the rotor 14. The outlet 20 is located downstream of the rotor 14.

A drive 22 is configured to rotate the rotor 14 about a pivot 24. The pivot 24 is shown orientated vertically, but may have other orientations including a horizontal orientation. The rotor 14, when rotated, generates a changing magnetic field. The drive 22 may consist of an external power source such an electric motor, internal combustion engine, turbine, or any other power source capable of generating a rotational motion. A gear or pulley system may be used to transmit the energy from the power source to the rotor 14. In the alternative, the drive 22 may consist of a series of fins (not shown) that are attached to the rotor 14 so that the flowing liquid pushes against the fins causing the rotor 14 to rotate.

The magnetic particles and non-magnetic conductive particles are removed from the liquid as it flows through the particle separator 10. The liquid initially flows into the particle separator 10 at the inlet 18. Magnetic particles are removed from the liquid by being attracted and attached to the plurality of magnetic sections 16. Non-magnetic conductive particles are removed from the liquid by being repelled away from the rotor 14 in a direction away from the flow of the liquid by the changing magnetic field. The non-magnetic conductive particles may be directed toward a collection point 26 when they are repelled by the changing magnetic field. The changing magnetic field induces an eddy current inside the non-magnetic conductive particles which are then repelled away from the rotor 14 according to Lenz's Law. Lenz's law states that the current induced due to a change or a motion in a magnetic field is so directed as to oppose the change in flux or to exert a mechanical force opposing the motion. The liquid then flows out of the particle separator 10 at the outlet 20 with the magnetic and non-magnetic conductive particles removed.

The plurality of magnetic sections 16 may be any type of magnet, including permanent magnets or electromagnets that are energized by a DC power source 28. Electromagnets, however, may be advantageous for maintenance purposes, because the plurality of magnetic sections 16 may be de-energized if they are comprised of electromagnets. The particle separator 10 may then be backwashed, while the plurality of magnetic sections 16 are de-energized, in order to remove the magnetic particles that have attached to the plurality of magnetic sections 16. If the plurality of magnetic sections 16 are comprised of permanent magnets, the rotor 14 would need to be removed from the particle separator 10 and be power washed to remove the magnetic particles attached to the plurality of magnetic sections 16.

The magnetic particles may also be directed toward the collection point 26 when the particle separator 10 is backwashed. The collection point 26 may include a valve 30 for flushing the magnetic and non-magnetic particles out of the particle separator 10 that are collected at the collection point 26.

Figure 2:
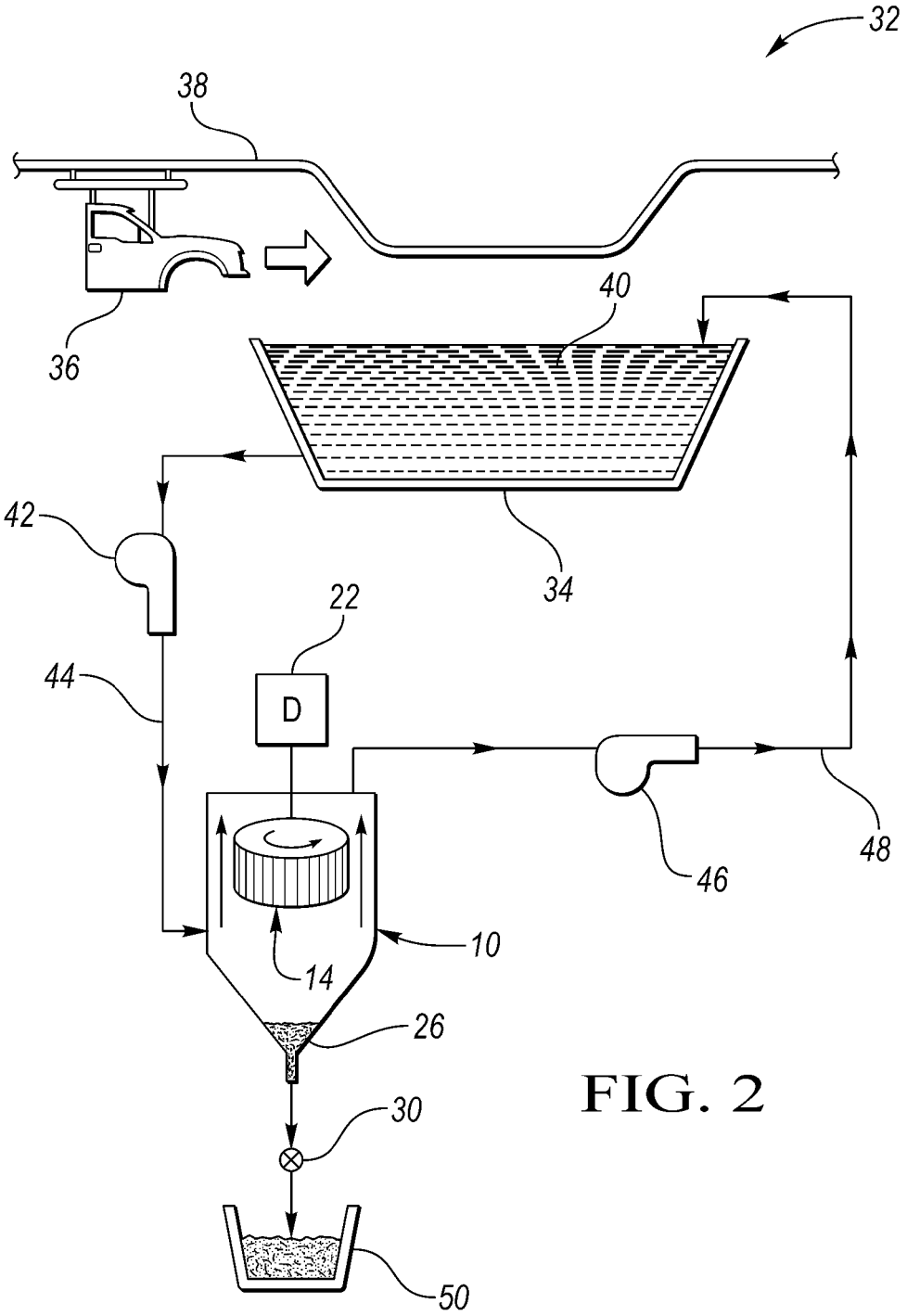
FIG. 2 is a diagrammatic view of a particle separation system for removing magnetic and non-magnetic conductive particles from a liquid coating.

Referring to FIG. 2, a particle separation system 32 is illustrated for removing magnetic and non-magnetic conductive particles from an immersion tank 34. A vehicle body-in-white 36 is dipped into to the immersion tank 34 via a conveyer system 38. The vehicle body-in-white 36 may be a car body, truck cabin, truck bed, or any other part of a vehicle body that goes through a coating process. The immersion tank 34 contains a liquid coating 40 such as a phosphate pretreatment coating or electrophoretic coating (e-coating). The pretreatment coating may, in the alternative, be any type of pretreatment coating for vehicle body-in-white 36, such as Zirconium Oxide.

Phosphate coatings are used on metal parts for corrosion resistance, lubricity, or as a foundation for subsequent coatings or painting. Phosphate coatings are a conversion coating including a dilute solution of phosphoric acid and phosphate salts that is applied via spraying or immersion and chemically reacts with the surface of the part being coated to form a layer of insoluble, crystalline phosphates.

Electrophoretic coatings are an emulsion of organic resins and de-ionized water in a stable condition. The electrophoretic coating solution also comprises solvent and ionic components. When a DC voltage is applied across two immersed electrodes, the current flow causes electrolysis of the water. This results in oxygen gas being liberated at the anode (positive electrode) and hydrogen gas being liberated at the cathode (negative electrode). The release of these gases disturbs the hydrogen ion equilibrium in the water immediately surrounding the electrodes. This results in a corresponding pH change and de-stabilizes the paint components of the solution that are coagulated onto the appropriate electrode.

An unfinished product is immersed in a bath containing the electrophoretic paint emulsion, and then an electric current is passed through both the product and the emulsion. The paint particles that are in contact with the product adhere to the surface and build up an electrically insulating layer. This layer prevents any further electrical current passing through, resulting in a level coating even in the recessed parts of complex-shaped goods.

With continued reference to FIG. 2, magnetic and non-magnetic conductive particles that have accumulated on the vehicle body-in-white 36 during the manufacturing and assembly processes are removed from the vehicle body-in-white 36 and transferred into the liquid coating 40 inside the immersion tank 34. The liquid coating 40 is then pumped into the particle separator 10, via a first pump 42, through a first channel 44. The magnetic and non-magnetic conductive particles are removed from the liquid coating 40 by the particle separator 10, as described above. The liquid coating 40 is then pumped back into the immersion tank 34, via a second pump 46, through a second channel 48.

A scrap bin 50 may be utilized to collect the magnetic and non-magnetic particles that are flushed out of the particle separator 10 when the valve 30 is opened. If the plurality of magnetic sections 16 are electromagnets, the DC power can be left on while the non-magnetic conductive particles are flushed out. The DC power may then be turned off and the magnetic particles flushed out. This allows for separation of the magnetic and non-magnetic conductive particles for ease of recycling and disposing.

Figure 3:
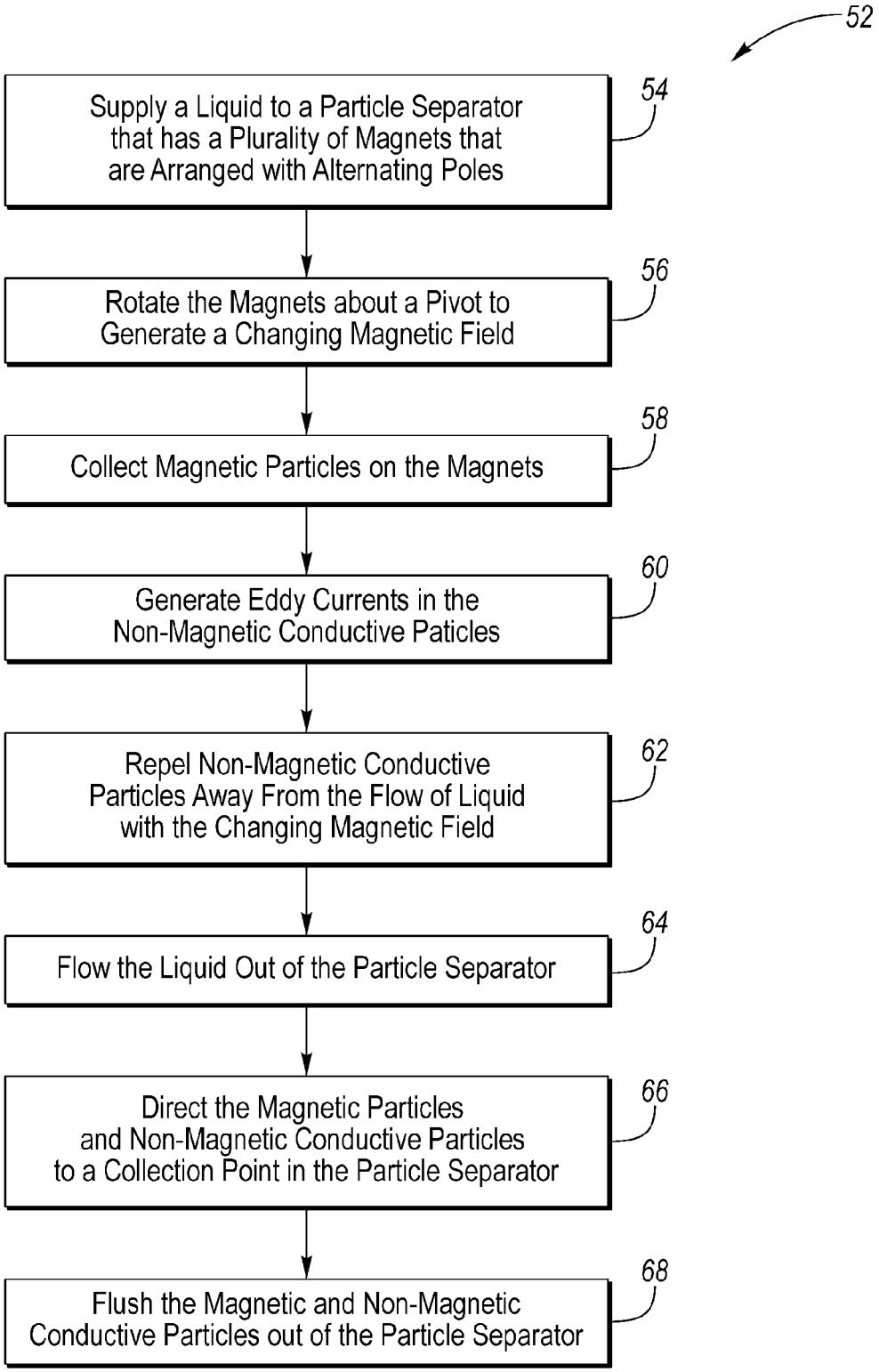
FIG. 3 is a flowchart illustrating a method for removing magnetic and non-magnetic conductive particles from a liquid.

Referring to FIG. 3, a method 52 of removing magnetic and non-magnetic conductive particles from a liquid is illustrated. At step 54 the liquid is supplied to a particle separator. The particle separator has a plurality of magnets that are arranged with alternating poles. The plurality of magnets are rotated about a pivot and generate a changing magnetic field at step 56. At step 58 the plurality of magnets attract and collect magnetic particles. The magnetic particles attach to the plurality of magnets. At step 60 the changing magnetic field generates eddy currents in the non-magnetic conductive particles. The changing magnetic field then repels the non-magnetic conductive particles in a direction away from the flow of the liquid at step 62. The liquid then flows out of the particle separator at step 64. The magnetic and non-magnetic conductive particles are directed to collection point in the particle separator at step 66 and are flushed out of the particle separator at step 68.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A particle separator comprising:

a housing;

a rotor, disposed inside the housing, having a plurality of electromagnets arranged with alternating poles, wherein rotation of the rotor and energizing the electromagnets generates a changing magnetic field and eddy currents in non-magnetic conductive particles in a liquid coating flowing though the housing, and wherein the non-magnetic conductive particles are repelled in a direction away from a flow of the coating to a collection point in the housing via the magnetic field, magnetic particles in the coating adhere to the electromagnets when energized, and the magnetic particles are directed toward the collection point via de-energizing the electromagnets; and a valve configured to flush the magnetic and non-magnetic conductive particles out of the housing at the collection point.

2. The particle separator of claim 1 further comprising an electric motor configured to rotate the rotor.

3. The particle separator of claim 1, wherein the liquid flows into the housing at an inlet upstream of the rotor and flows out of the housing at an outlet downstream of the rotor.

4. A particle separation system comprising:

an immersion tank containing a liquid coating;

a housing;

a particle separator disposed inside the housing and having a plurality of electromagnets with alternating poles; and a rotational power source configured to rotate the particle separator to generate a changing magnetic field, wherein the liquid coating flows into the housing from the immersion tank through a first channel, magnetic particles in the liquid coating attach to the plurality of electromagnets, the changing magnetic field generates eddy currents in non-magnetic conductive particles in the liquid coating, the non-magnetic conductive particles are repelled by the changing magnetic field in a direction away from the flow of the liquid coating and toward a collection point in the housing, the magnetic particles attached to the plurality of electromagnets are directed to the collection point when the electromagnets are de-energized, and the liquid coating is returned to the immersion tank through a second channel; and a valve for flushing the non-magnetic conductive and magnetic particles out of the housing at the collection point.

5. The system of claim 4, wherein the rotational power source is an electric motor.

6. The system of claim 4, wherein the non-magnetic conductive particles are aluminum or aluminum alloys.

7. The system of claim 4, wherein the liquid coating is a phosphate coating.

8. The system of claim 4, wherein the liquid coating is an electrophoretic coating.

* * * * *